US010954844B2

(12) United States Patent
Boemer et al.

(10) Patent No.: US 10,954,844 B2
(45) Date of Patent: Mar. 23, 2021

(54) COMMON RAIL WATER JACKET

(71) Applicant: DEUTZ Aktiengesellschaft, Cologne (DE)

(72) Inventors: Andreas Boemer, Cologne (DE); Marco Jung, Cologne (DE)

(73) Assignee: Deutz Aktiengesellschaft, Cologne (DE)

( * ) Notice: Subject to any disclaimer, the term of this patent is extended or adjusted under 35 U.S.C. 154(b) by 42 days.

(21) Appl. No.: 15/774,678

(22) PCT Filed: Nov. 3, 2016

(86) PCT No.: PCT/EP2016/001827
§ 371 (c)(1),
(2) Date: May 9, 2018

(87) PCT Pub. No.: WO2017/080636
PCT Pub. Date: May 18, 2017

(65) Prior Publication Data

US 2018/0347443 A1 Dec. 6, 2018

(30) Foreign Application Priority Data

Nov. 11, 2015 (DE) ..... 10 2015 014 514.2

(51) Int. Cl.

| | |
|---|---|
| ***F01P 3/02*** | (2006.01) |
| ***F02F 1/10*** | (2006.01) |
| ***F02F 1/40*** | (2006.01) |
| ***F02M 26/28*** | (2016.01) |
| ***F02M 26/30*** | (2016.01) |

(Continued)

(52) U.S. Cl.
CPC ..... *F01P 3/02* (2013.01); *F01P 3/20* (2013.01); *F01P 7/165* (2013.01); *F02F 1/10* (2013.01); *F02F 1/14* (2013.01); *F02F 1/36* (2013.01); *F02F 1/40* (2013.01); *F02M 26/28* (2016.02); *F02M 26/30* (2016.02); *F02M 26/32* (2016.02);

(Continued)

(58) Field of Classification Search
CPC ..... F01P 3/02; F01P 7/165; F01P 2003/027; F02F 1/14; F02F 1/40; F02F 1/102; F02F 1/36; F02M 26/28; F02M 26/30; F02M 26/32
USPC ..... 123/41.28, 41.29, 41.74, 41.82 R, 41.72
See application file for complete search history.

(56) References Cited

U.S. PATENT DOCUMENTS

| | | | |
|---|---|---|---|
| 2,713,332 | A | 7/1955 | Beardsley et al. |
| 3,889,644 | A | 6/1975 | Moore |

(Continued)

FOREIGN PATENT DOCUMENTS

| | | |
|---|---|---|
| AT | 508 178 A2 | 11/2010 |
| DE | 12 20 203 | 6/1966 |

(Continued)

*Primary Examiner* — Erick R Solis
(74) *Attorney, Agent, or Firm* — Davidson, Davidson & Kappel, LLC

(57) ABSTRACT

Described is an internal combustion engine, in particular including a dual-circuit water cooling system, including a crankcase and at least one inlet and/or outlet rail which is/are situated upstream from the crankcase and receives a coolant communicating with this crankcase, at least one coolant-conducting cylinder head, and at least one outlet and/or inlet rail downstream from the cylinder head receiving a coolant communicating with the cylinder head.

14 Claims, 8 Drawing Sheets

(51) Int. Cl.

| | |
|---|---|
| ***F02F 1/14*** | (2006.01) |
| ***F02F 1/36*** | (2006.01) |
| ***F01P 7/16*** | (2006.01) |
| ***F02M 26/32*** | (2016.01) |
| ***F01P 3/20*** | (2006.01) |

(52) U.S. Cl.
CPC ..... *F01P 2003/027* (2013.01); *F01P 2060/00* (2013.01)

(56) References Cited

U.S. PATENT DOCUMENTS

| | | | | |
|---|---|---|---|---|
| 4,348,991 | A * | 9/1982 | Stang | F02B 29/0443 123/41.29 |
| 4,665,867 | A | 5/1987 | Iwamoto et al. | |
| 5,769,038 | A * | 6/1998 | Takahashi | F01P 3/202 123/41.74 |
| 5,915,346 | A | 6/1999 | Rehr et al. | |
| 6,810,838 | B1 * | 11/2004 | Hellman | F01P 3/02 123/41.28 |
| 7,430,994 | B2 | 10/2008 | Petutsching et al. | |
| 8,857,387 | B2 | 10/2014 | Schlidt | |
| 2003/0000487 | A1 * | 1/2003 | Schmitt | F01P 3/02 123/41.72 |
| 2006/0005791 | A1 * | 1/2006 | Obidi | F02M 26/28 123/41.29 |
| 2006/0011151 | A1 | 1/2006 | Huter et al. | |
| 2006/0096555 | A1 * | 5/2006 | Buck | F01P 3/207 123/41.28 |
| 2011/0259287 | A1 * | 10/2011 | Kakehashi | F01P 7/164 123/41.09 |
| 2012/0240876 | A1 | 9/2012 | Zahdeh et al. | |
| 2014/0261257 | A1 * | 9/2014 | Williams | F01P 9/02 123/41.44 |
| 2015/0101549 | A1 * | 4/2015 | Bilancia | F01P 1/06 123/41.31 |
| 2015/0176471 | A1 * | 6/2015 | Hutchins | F01P 7/16 236/34.5 |
| 2017/0107889 | A1 * | 4/2017 | Tempesta | F02F 1/40 |
| 2018/0066566 | A1 * | 3/2018 | Amann | F01P 3/20 |
| 2018/0223721 | A1 * | 8/2018 | Matsushita | F01P 7/162 |
| 2018/0230934 | A1 * | 8/2018 | Hopf | F01P 5/10 |
| 2018/0298808 | A1 * | 10/2018 | Sugiura | F01P 7/165 |

FOREIGN PATENT DOCUMENTS

| | | |
|---|---|---|
| DE | 101459 | 11/1973 |
| DE | 2417925 | 10/1974 |
| DE | 196 28 762 A1 | 1/1998 |
| DE | 60310539 | 9/2007 |
| DE | 102010052830 | 5/2012 |
| DE | 10 2013 113 609 | 6/2015 |
| EP | 1491739 | 12/2004 |
| FR | 2225628 | 11/1974 |

* cited by examiner

--Prior Art--

COMMON RAIL WATER JACKET

The present invention relates to a dual-circuit water cooling system of an internal combustion engine.

BACKGROUND

Such internal combustion engines are known from DE 196 28 762 A1, for example, which shows a cooling circuit of an internal combustion engine including a cast cylinder block including a cooling water jacket, a cylinder head having cooling water channels, a shared flange surface between the cylinder head and the cylinder block, and cooling water guides within the cylinder block, which are designed as supply or return channels, of which at least one cooling water guide opens into the flange surface, a connection in the form of a slot which originates from the flange surface and is cast into the cylinder block existing between the cooling water jacket and at least one of the cooling water guides.

In existing known cooling water jackets, the water is conducted in different ways from the pump to the passages in the crankcase to be cooled. Usually there is only one inlet, or a maximum of two inlets, into the water jacket of the crankcase. The thermostat is usually attached to an end face of the cylinder head. This results in uneven distributions of the water among the individual cylinders, which can only be compensated for by adapted reductions of the passages in the cylinder head gasket. These passage reductions result in increased pressure losses, an increased pump rate, and thus ultimately in increased fuel consumption. The water flowing through the sealing passages from the crankcase into the head is able to leave the head only on one side, whereby a drastically varying water supply of the individual areas in the head is inevitable.

SUMMARY OF THE INVENTION

It is an object of the present invention to avoid the above-described disadvantages and to create an internal combustion engine and a method for operating such an internal combustion engine, which conducts the coolant flows to the cooling sites in a largely low-loss manner.

The present invention provides an internal combustion engine, in particular including a dual-circuit water cooling system, including a crankcase having a water jacket and at least one inlet and/or outlet rail which is situated in front of the crankcase and communicates with the crankcase and receives a coolant, at least one coolant-conducting cylinder head, and at least one outlet and/or inlet rail which communicates with the cylinder head and receives coolant. The object is also achieved by a method for operating an internal combustion engine, characterized in that a device as recited in one or multiple of the preceding claims is used.

It is advantageous that the cooling circuit has a low pressure loss and an even distribution of the coolant. This saves pump power, generates less cylinder distortion and ensures effective cooling action.

BRIEF DESCRIPTION OF THE DRAWINGS

The present invention is described in greater detail hereafter based on one exemplary embodiment shown in the drawing.

DETAILED DESCRIPTION

Figure 1:
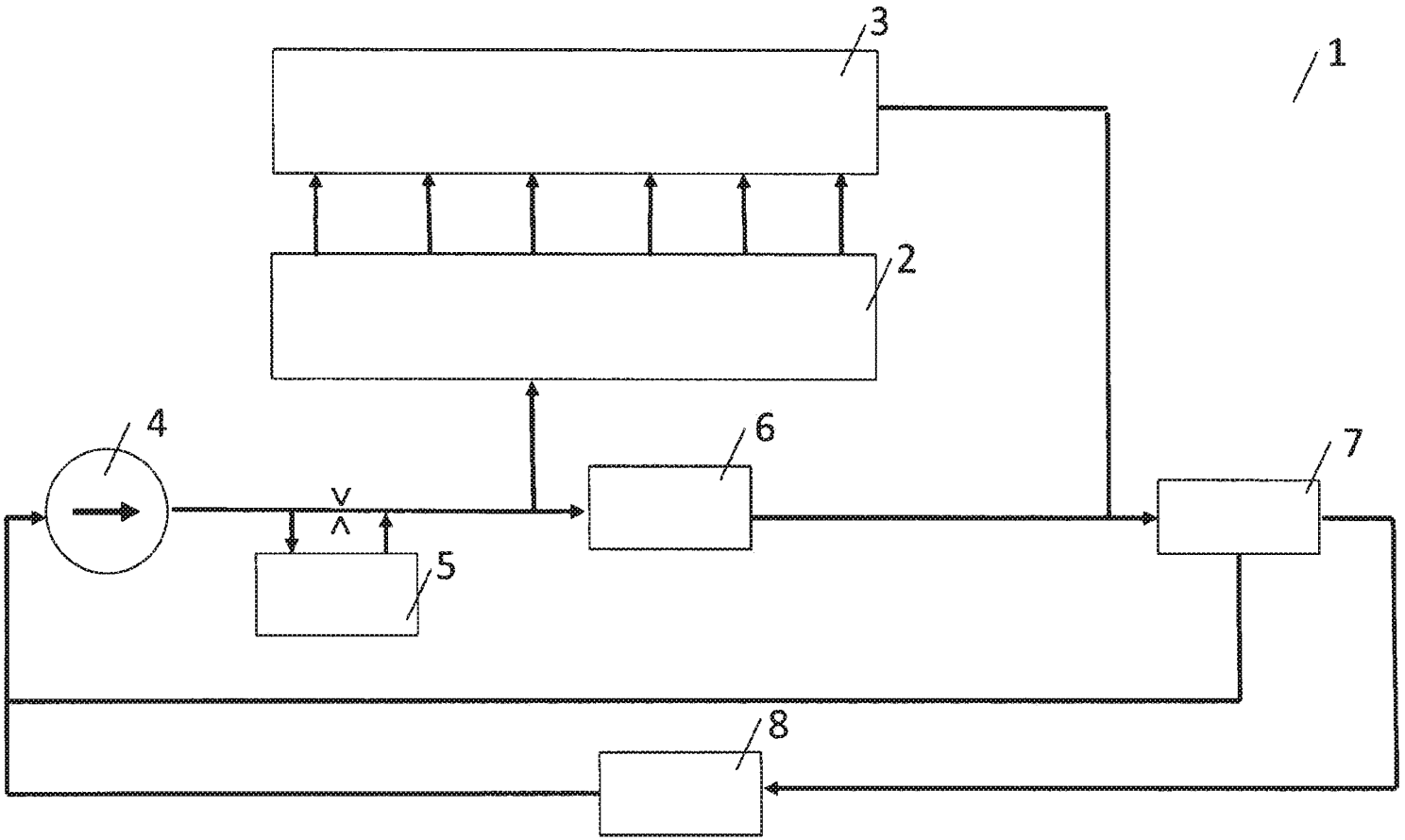
FIG. 1 shows a standard single-circuit water circuit.

FIG. 1 shows a standard single-circuit water circuit by way of example, including an internal combustion engine 1, which has a crankcase 2 and a cylinder head 3 fastened thereon. The cooling circuit of internal combustion engine 1 includes a coolant pump 4, downstream from which an engine oil cooler 5 is situated in the flow direction of the coolant. Downstream from the engine oil cooler 5 in the flow direction of the coolant, the coolant flow branches into exhaust gas recirculation (EGR) cooler 6 and crankcase 2. After the coolant has flowed through crankcase 2, it reaches cylinder head 3. After the coolant has flowed through cylinder head 3, it combines with the subflow of the coolant flowing out of exhaust gas recirculation (EGR) cooler 6. This combined coolant flow now reaches thermostat 7, which, depending on the working position, either conducts the coolant flow directly to coolant pump 4 or allows it to take the detour via cooler 8.

Figure 2:
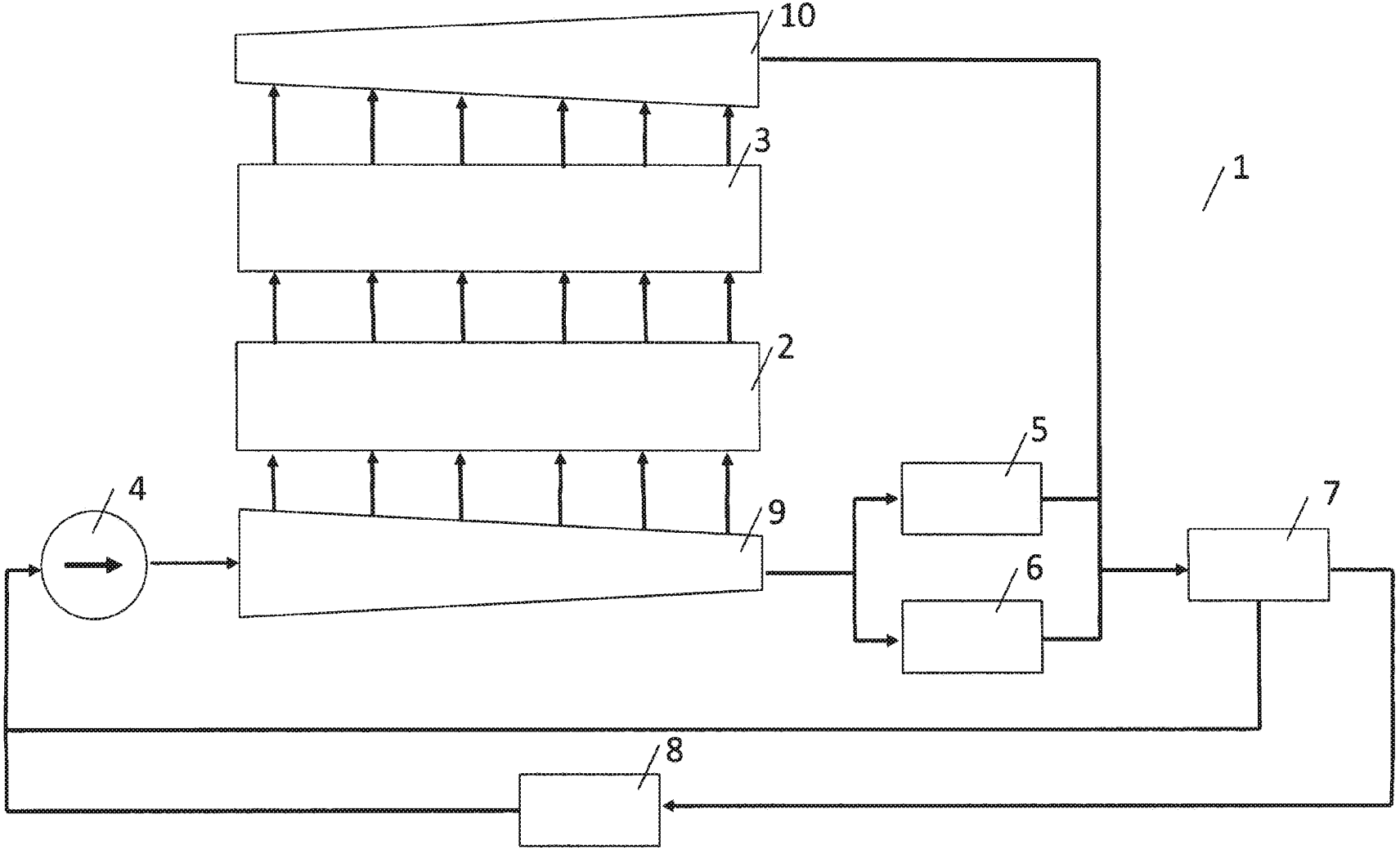
FIG. 2 shows a common rail water jacket, single-circuit water circuit.

FIG. 2 shows a common rail water jacket single-circuit water circuit by way of example.

A water flow in crankcase 2 and in cylinder head 3 flowing essentially in the transverse direction is advantageous from a cooling perspective.

An inlet volume ("common rail"), into which the water from the pump can flow in a low-loss manner, is attached in front of the inlet into the crankcase. From this rail, the water flows are evenly conducted to the individual cylinders. Moreover, it is possible to withdraw water from this rail for other coolers, such as the EGR cooler and engine oil cooler, as needed. The respective water volume flows may be adapted by the cross sections. In the optimal case the rail should be conical to enable uniform water velocities and low-loss water removals. After the water has flowed transversely through the cylinder passages in the crankcase, it flows through the cylinder head gasket on the other side upwardly into the head. Thereafter, there is also a transverse flow through the head. When leaving the head area (ideally on the side of the outlet channels to provide maximum cooling there), the water flows into a second volume, the outlet rail, which should also be conically shaped in accordance with the water volumes. From there, the water typically flows on to the thermostat. This is schematically shown in FIG. 2 for a single-circuit water circuit.

Shown is internal combustion engine 1, which includes a crankcase 2 and a cylinder head 3 fastened thereon. The cooling circuit of internal combustion engine 1 includes a coolant pump 4, downstream from which in the flow direction of the coolant an inlet rail 9 is situated, the coolant flow in the flow direction branching into an engine oil cooler (MÖK) 5 and an exhaust gas recirculation (EGR) cooler 6, which are situated upstream of or downstream from inlet rail 9, and into crankcase 2. Downstream from engine oil cooler 5 and exhaust gas recirculation (EGR) cooler 6 in the flow direction of the coolant, the coolant flow combines with the coolant subflow exiting outlet rail 10. The coolant of the subflow originating from inlet rail 9 flows through crankcase 2, and after having flowed through crankcase 2, it reaches cylinder head 3. After the coolant has flowed through cylinder head 3, it flows into outlet rail 10. This combined coolant flow originating from outlet rail 10, engine oil cooler 5 and EGR 6 now reaches thermostat 7, which, depending on the working position, either conducts the coolant flow directly to coolant pump 4 or allows it to take the detour via cooler 8.

Figure 3:
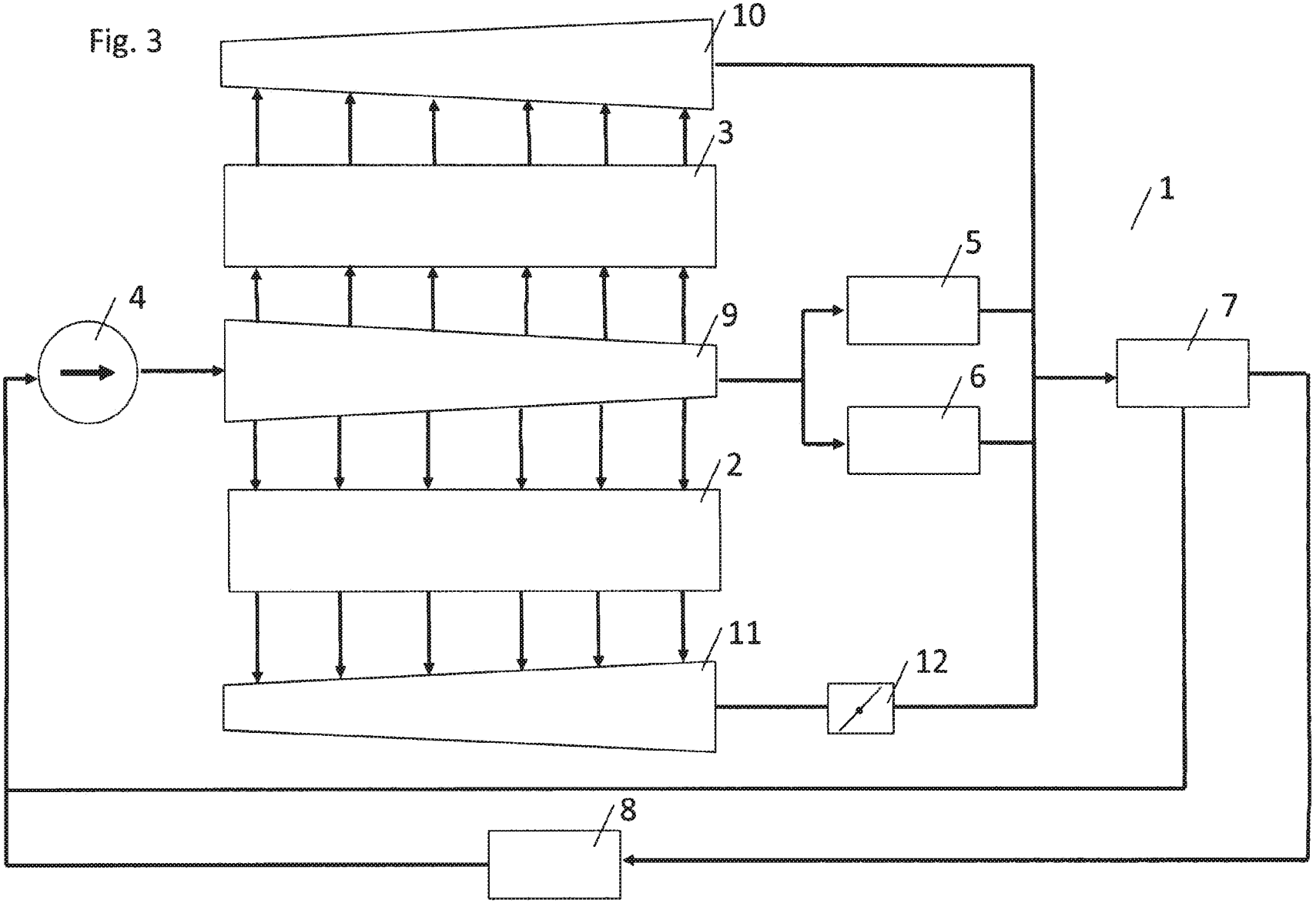
FIG. 3 shows a common rail water jacket, dual-circuit water circuit.

When a dual-circuit water circuit according to FIG. 3 ("split cooling") is used, two separate outlet rails are used, so that the cooling of the crankcase may be switched off using a regulated flap for faster warming of the engine. Such a diagram is shown in FIG. 3.

Figure 4:
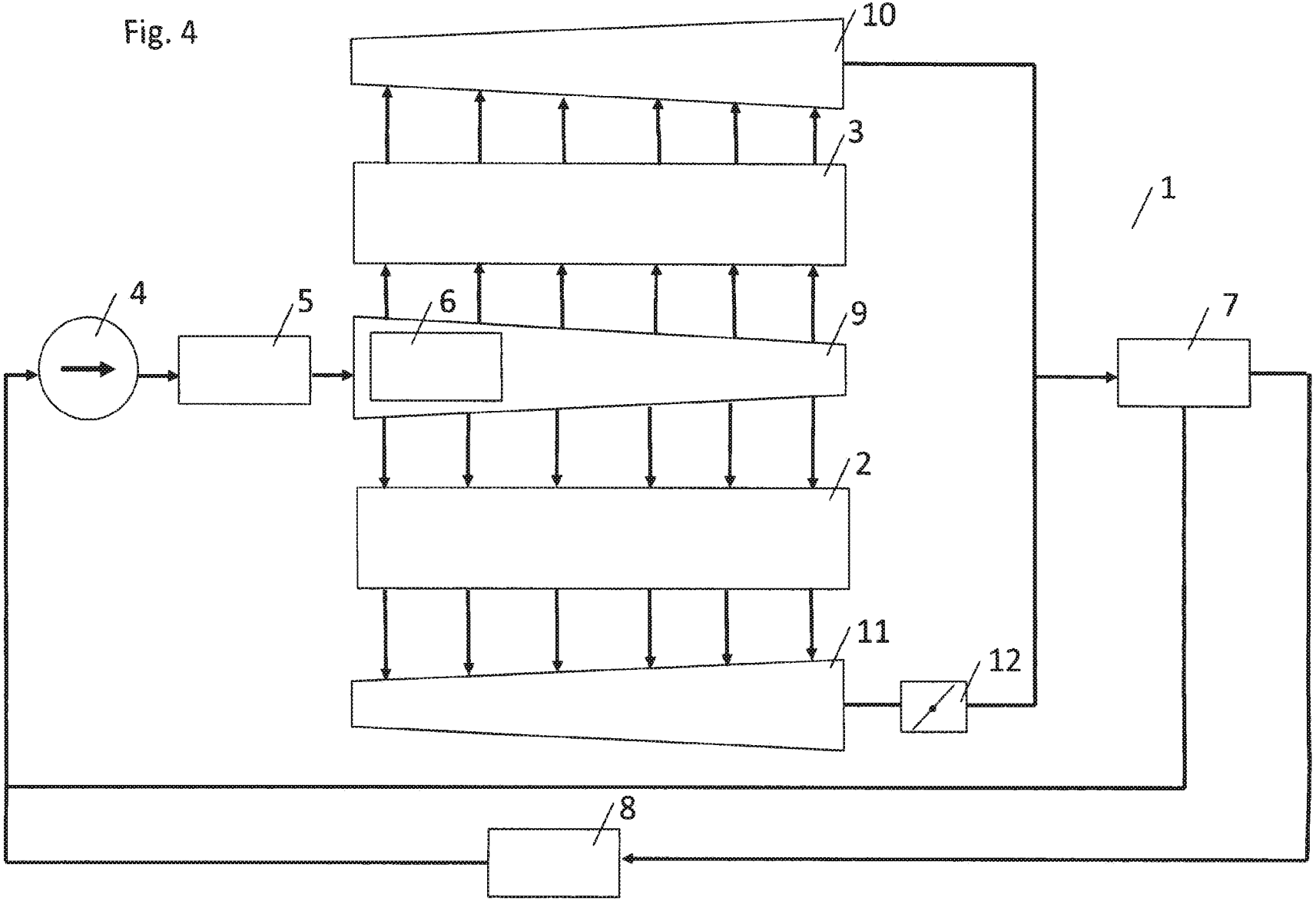
FIG. 4 shows a common rail water jacket, dual-circuit water circuit including an oil cooler in the inlet rail.

FIG. 3 describes a common rail water jacket dual-circuit water circuit having "split cooling" (FIGS. 3 and 4).

A water flow in crankcase 2 and in cylinder head 3 flowing essentially in the transverse direction and the ability to switch off the crankcase cooling system for faster warming of the engine are advantageous from a cooling perspective.

FIG. 3 shows internal combustion engine 1 by way of example, which includes a crankcase 2 and a cylinder head 3 fastened thereon. The cooling circuit of internal combustion engine 1 includes a coolant pump 4, downstream from which in the flow direction of the coolant an inlet rail 9 is situated, the coolant flow in the flow direction branching into an engine oil cooler 5 and an exhaust gas recirculation (EGR) cooler 6, which are situated downstream from inlet rail 9, and into crankcase 2 and cylinder head 3. Downstream from engine oil cooler-5 and exhaust gas recirculation (EGR) cooler 6 in the flow direction of the coolant, the coolant flow combines with the coolant subflow exiting outlet rail 10 of the cylinder head and outlet rail 11 of the crankcase. The subflow of the coolant exiting outlet rail 11 of the crankcase flows through a regulated flap 12, which communicates with the engine control unit which is not shown. Regulated flap 12 is able to control, or at least switch on and off, the coolant flow originating from outlet rail 11 of the crankcase in terms of volume. The throughput range of the regulated flap is between the boundary conditions "full throughput" and "completely closed." The coolant of the subflow originating from inlet rail 9 on the one hand flows through crankcase 2 and cylinder head 3. After the coolant has flowed through crankcase 2, it reaches outlet rail 11. After the other subflow of the inlet rail coolant has flowed through cylinder head 3, it flows into outlet rail 10 of the cylinder head. This combined coolant flow originating from outlet rail 10, outlet rail 11, engine oil cooler 5 and EGR 6 now reaches thermostat 7, which, depending on the working position, either conducts the coolant flow directly to coolant pump 4 or allows it to take the detour via cooler 8.

In both cases, the common rail water jacket enables particularly effective, uniform and low pressure loss transverse cooling of crankcase 2 and cylinder head 3. The details are to be designed with the aid of CFD calculations.

FIG. 4 shows a common rail water jacket including a dual-circuit water circuit and oil cooler 13 in inlet rail 9.

A water flow in crankcase 2 and in cylinder head 3 flowing essentially in the transverse direction is advantageous from a cooling perspective.

FIG. 4 shows internal combustion engine 1 by way of example, which includes a crankcase 2 and a cylinder head 3 fastened thereon. The cooling circuit of internal combustion engine 1 includes a coolant pump 4, downstream from which in the flow direction of the coolant an inlet rail 9 is situated, the coolant flow in the flow direction branching into an engine oil cooler 5 and an exhaust gas recirculation (EGR) cooler 6, which are situated downstream from inlet rail 9, and into crankcase 2 and cylinder head 3. Downstream from engine oil cooler 5 and exhaust gas recirculation (EGR) cooler 6 in the flow direction of the coolant, the coolant flow combines with the coolant subflow exiting outlet rail 10 of the cylinder head and outlet rail 11 of the crankcase. The subflow of the coolant exiting outlet rail 11 of the crankcase flows through a regulated flap 12, which communicates with the engine control unit which is not shown. Regulated flap 12 is able to control the coolant flow originating from outlet rail 11 of the crankcase in terms of volume. The throughput range of the regulated flap is between the boundary conditions "full throughput" and "completely closed." The coolant of the subflow originating from inlet rail 9 on the one hand flows through crankcase 2 and cylinder head 3. After the coolant has flowed through crankcase 2, it reaches outlet rail 11. After the other subflow of the inlet rail coolant has flowed through cylinder head 3, it flows into outlet rail 10 of the cylinder head. This combined coolant flow originating from outlet rail 10, outlet rail 11, engine oil cooler 5 and EGR 6 now reaches thermostat 7, which, depending on the working position, either conducts the coolant flow directly to coolant pump 4 or allows it to take the detour via cooler 8.

Figure 5:
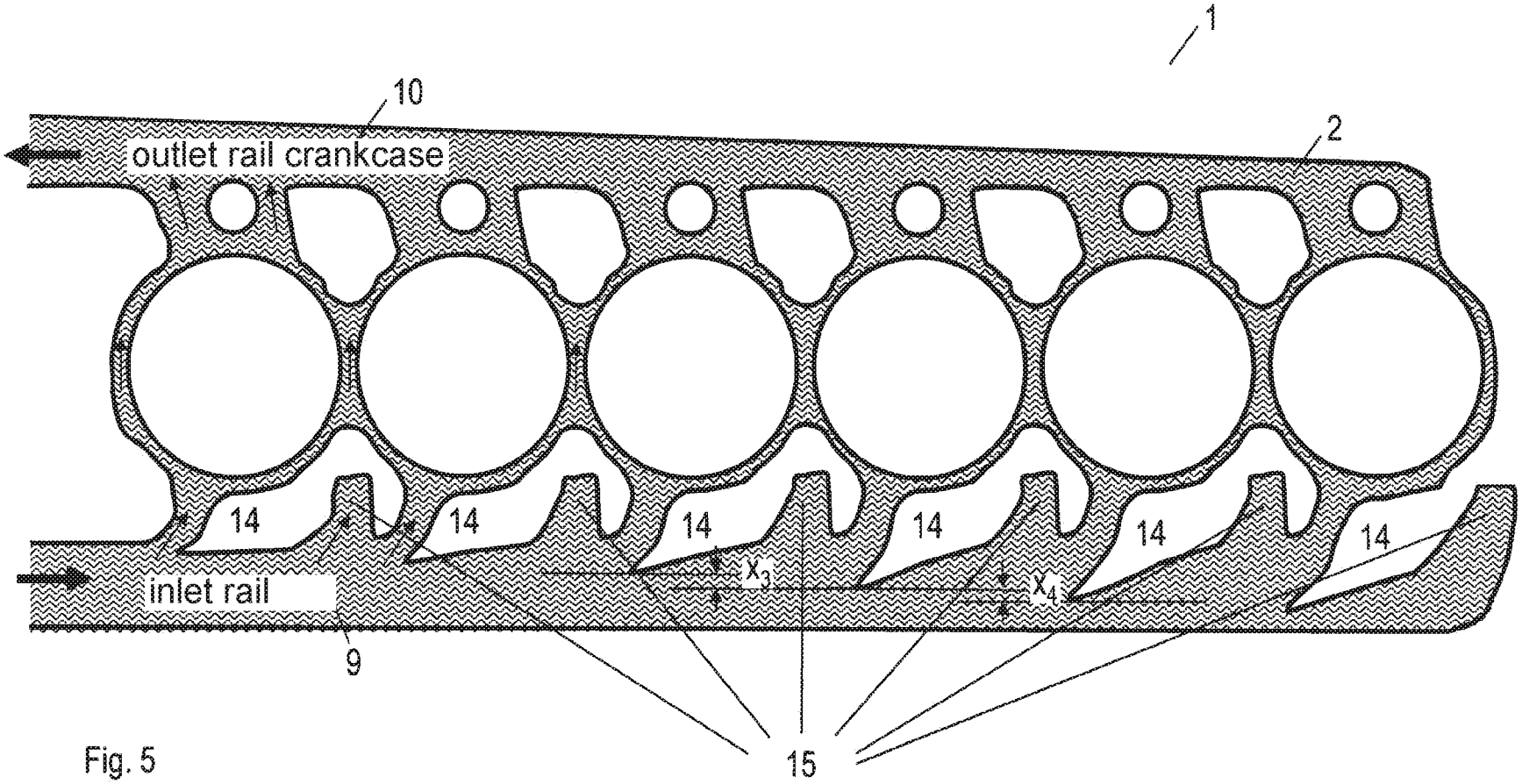
FIG. 5 shows the water guide in the crankcase including flow guide vanes on the inlet side.
Figure 6:
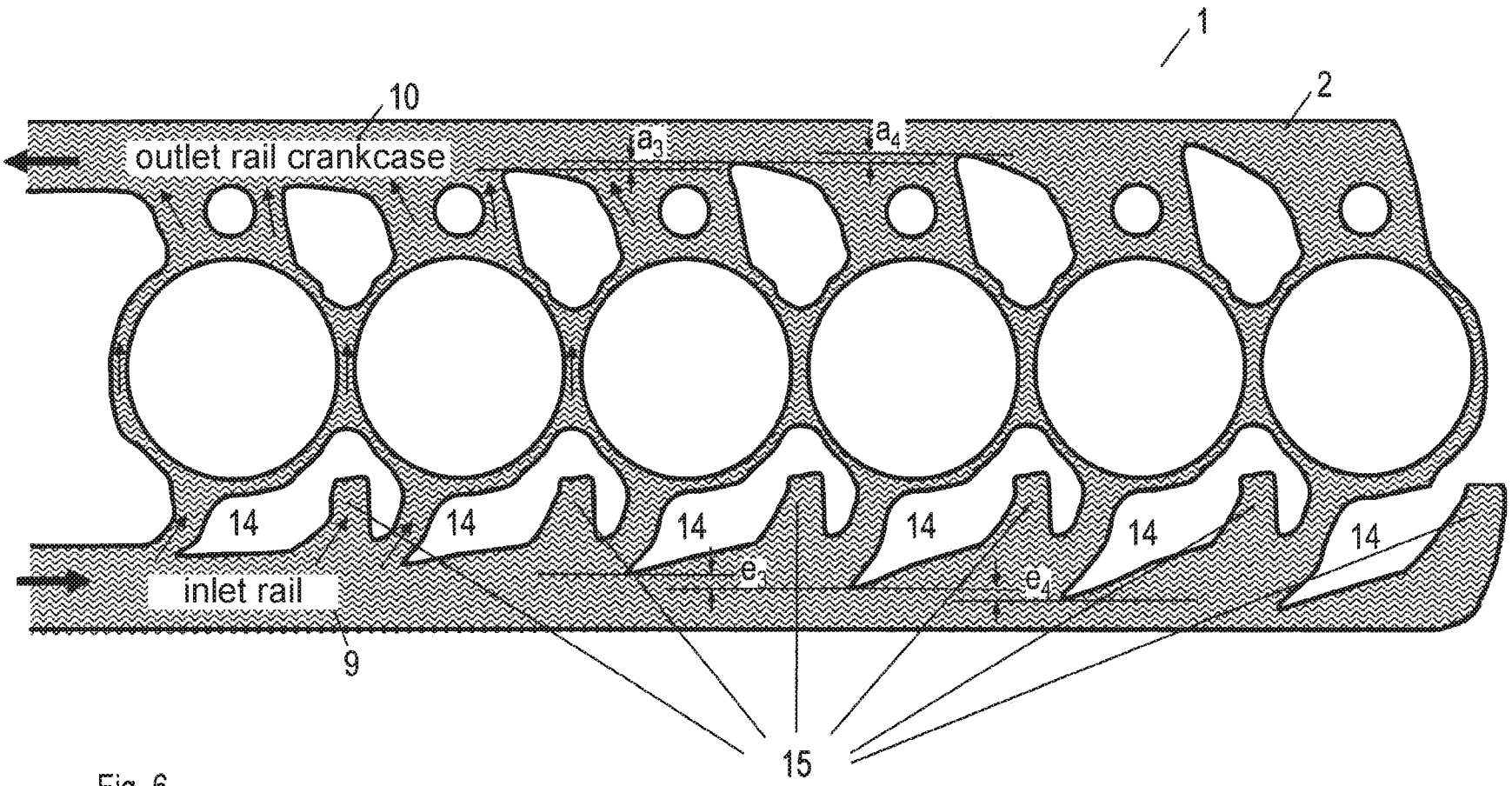
FIG. 6 shows the water guide in the crankcase including flow guide vanes on the inlet and outlet sides.

FIG. 5 shows the water guide in crankcase 2 of six-cylinder internal combustion engine 1 by way of example, including flow guide vanes 14 designed as claws on the inlet side. The flow guide vanes are to be considered as a replacement for or in addition to the conical shape of the rail. In FIG. 6 they are not conically designed by way of example. Internal combustion engine 1 includes claw-like flow guide vanes 14 in the water jacket guide. The claw-like water jacket guide has an individual depth x(1-6) between the end tips of the flow guide vanes 14. It is apparent from FIG. 5 that the outlet rails 10 and/or inlet rails 9, which have a conical design here, are an integral part of the water jacket. The flow of the coolant takes place within the flow guide vanes upwardly into cylinder head 15. The depth x is designed with the aid of CFD.

FIG. 6 shows the water guide in crankcase 2 of internal combustion engine 1, which in this example has six cylinders, including flow guide vanes 14 designed as claws on the inlet and outlet sides. Internal combustion engine 1 includes claw-like flow guide vanes 14 in the water jacket guide, which are situated both on the inlet side and on the outlet side. The claw-like water jacket guide has an individual depth a(1-6), e(1-6) between the end tips of the flow guide vanes 14. In this way, a targeted and low-loss flow guidance may be achieved. It is apparent from FIG. 6 that the outlet rails 10, 11 and/or inlet rails 9 are an integral part of the water jacket.

Figure 7:
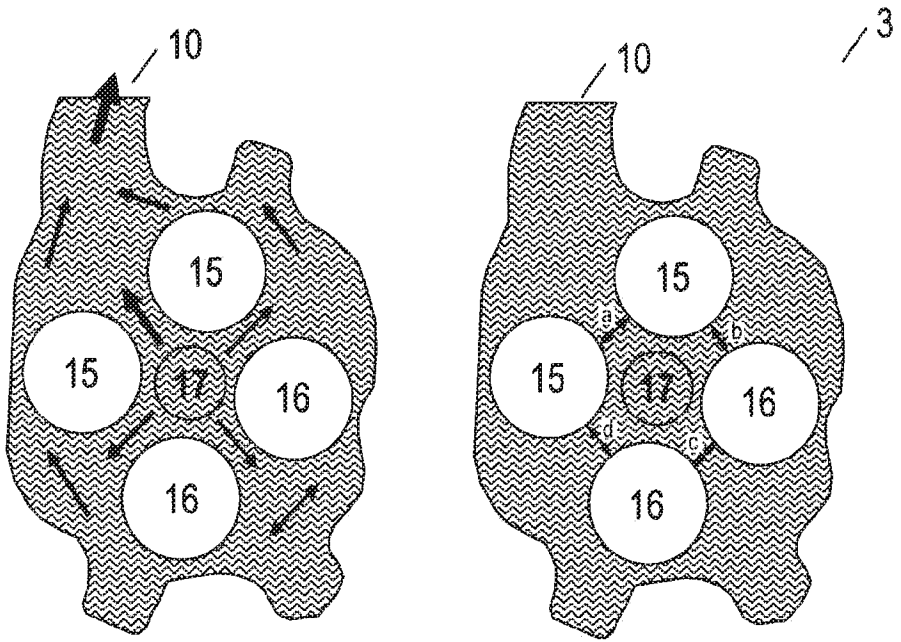
FIG. 7 shows the water guide between the valves.

FIG. 7 shows the water guide between the valves in cylinder head 3.

FIG. 7 represents the water guide between exhaust valves 15, intake valves 16 and injector 17. The main cooling water flow takes place between the hot outlet channels. Distances a, b, c, d between the valves are designed with the aid of computational fluid dynamics (CFD).

Figure 8:
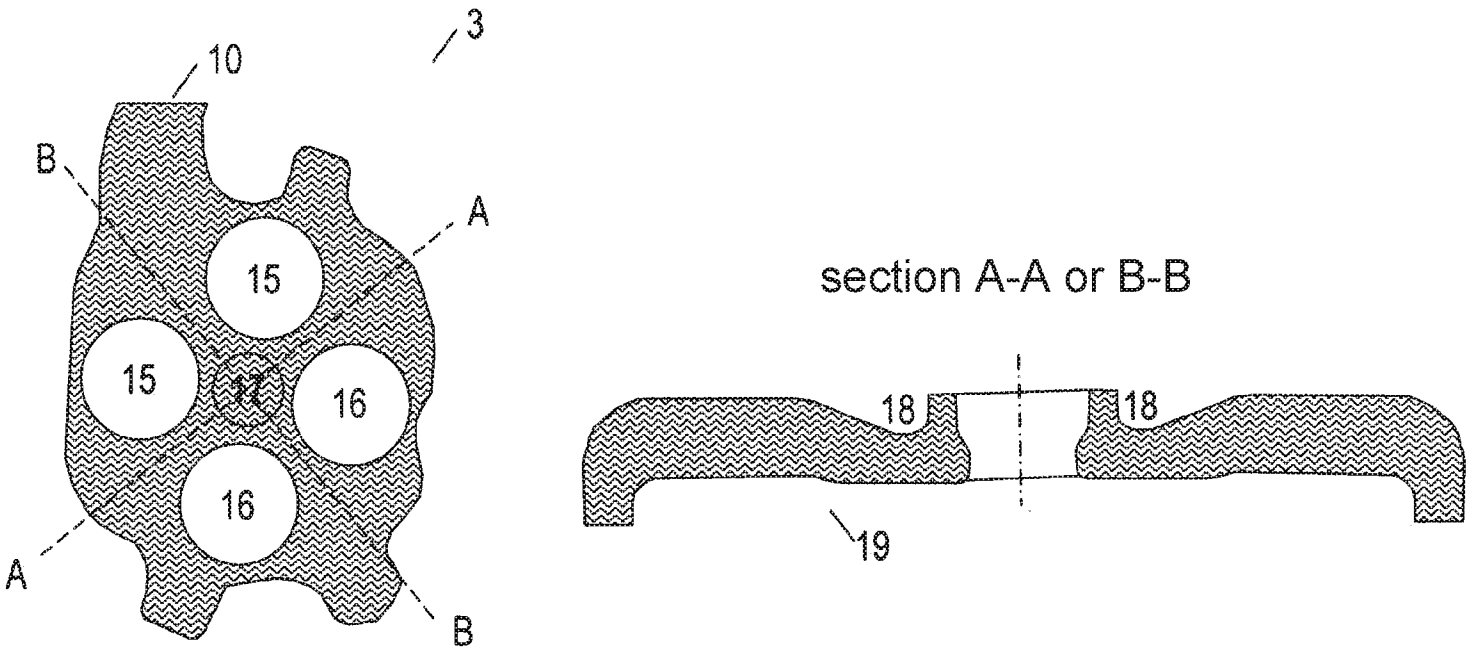
FIG. 8 shows the combustion base.

FIG. 8 shows combustion base 19 along intersecting line A-A or B-B between valves 15, 16 in cylinder head 3. For better cooling of the combustion base 19, the water jacket bulges downwardly with the aid of individually designed nose-like flow guide vanes 18.

LIST OF REFERENCE NUMERALS

1 internal combustion engine
2 crankcase

3 cylinder head
4 coolant pump
5 engine oil cooler
6 exhaust gas recirculation (EGR)
7 thermostat
8 cooler
9 inlet rail
10 outlet rail
11 outlet rail
12 regulated flap
13 oil cooler
14 flow guide vanes
15 exhaust valve
16 intake valve
17 injector
18 flow guide vanes
19 combustion base

The invention claimed is:

1. An internal combustion engine comprising:
cylinders;
a crankcase;
at least one coolant-conducting cylinder head; and
a dual-circuit water cooling system comprising:
a water jacket of the crankcase;
at least one inlet rail situated upstream from the water jacket and configured for receiving a coolant communicating with the water jacket; and
at least one outlet rail downstream from the cylinder head configured for receiving a coolant which communicates with the cylinder head, wherein the inlet rail is configured to communicate independently with the both the water jacket of the crankcase and with the cylinder head, the at least one inlet rail is a volume configured for conducting water flows at uniform water velocities to each of the cylinders.

2. The internal combustion engine as recited in claim 1 wherein the at least one outlet rail and/or the at least one inlet rail are/is formed in the crankcase integral with of the water jacket.

3. The internal combustion engine as recited in claim 1 wherein a cooling water main flow flows between hot outlet channels.

4. The internal combustion engine as recited in as recited in claim 1 wherein flow guide vanes having nose-shaped bulges towards a combustion base are situated between intake channels and exhaust channels.

5. The internal combustion engine as recited in claim 1 wherein the at least one outlet rail includes a first outlet rail and a second outlet rail, the crankcase in fluid communication with the first outlet rail, the cylinder head in fluid communication with the second outlet rail.

6. The internal combustion engine as recited in claim 1 wherein at least one of:
the at least one inlet rail is conical, and
the at one outlet rail is part of the water jacket, and
the at one inlet rail is part of the water jacket.

7. A method for operating an internal combustion engine comprising:
providing a dual-circuit water cooling system comprising:
a water jacket of a crankcase;
at least one inlet rail; and
at least one outlet rail;
flowing water from the at least one inlet rail in a first direction into the water jacket; and
flowing water from the at least one inlet rail in a second direction different from the first direction through at least one coolant-conducting cylinder head into at least one outlet rail,
wherein the at least one outlet rail includes a first outlet rail and a second outlet rail, the water flowing through the at least one coolant-conducting cylinder head into the first outlet rail, the method further comprising flowing water out of the water jacket into the second outlet rail.

8. An internal combustion engine comprising:
a crankcase;
at least one coolant-conducting cylinder head; and
a dual-circuit water cooling system comprising:
a water jacket of the crankcase;
at least one inlet rail situated upstream from the water jacket and configured for receiving a coolant communicating with the water jacket; and
at least one outlet rail downstream from the cylinder head configured for receiving a coolant which communicates with the cylinder head, wherein the inlet rail is configured to communicate independently with the both the water jacket of the crankcase and with the cylinder head,
wherein at least one of:
the inlet rail has a conical design,
the outlet rail has a conical design,
a water jacket guide of the crankcase has a claw shape, and
at least one exhaust gas recirculation cooler is integrated in the inlet rail.

9. The internal combustion engine as recited in claim 8 wherein the inlet rail has a conical design.

10. The internal combustion engine as recited in claim 8 wherein the outlet rail has a conical design.

11. The internal combustion engine as recited in claim 8 wherein a water jacket guide of the crankcase has a claw shape.

12. The internal combustion engine as recited in claim 11 wherein the water jacket guide includes flow guide vanes.

13. The internal combustion engine as recited in claim 12 wherein the water jacket guide has an individual depth.

14. The internal combustion engine as recited in claim 8 wherein at least one exhaust gas recirculation cooler is integrated in the inlet rail.

* * * * *